US005835106A

United States Patent [19]

No

[11] Patent Number: 5,835,106

[45] **Date of Patent: *Nov. 10, 1998**

[54] PRINTING SYSTEM FOR SECTIONAL CIRCULAR CONTAINER

[75] Inventor: Shinichiro No, Tokyo, Japan

[73] Assignee: Kabushiki Kaisha Yakult Honsha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 732,111

[22] Filed: Oct. 15, 1996

[30] Foreign Application Priority Data

Dec. 5, 1995 [JP] Japan ..... 7-316225

[51] Int. Cl.[6] ..... B41J 3/00; B41J 2/01

[52] U.S. Cl. ..... 347/2; 347/104

[58] Field of Search ..... 347/2, 4, 104, 347/7; 101/72, 35

[56] References Cited

U.S. PATENT DOCUMENTS

| | | | |
|---|---|---|---|
| 4,739,606 | 4/1988 | Cantile | 53/493 |
| 4,759,282 | 7/1988 | Talmadge | 101/35 |
| 5,306,084 | 4/1994 | Orii | 400/279 |
| 5,455,606 | 10/1995 | Keeling et al. | 347/7 |

*Primary Examiner*—N. Le
*Assistant Examiner*—Thinh Nguyen
*Attorney, Agent, or Firm*—Armstrong, Westerman, Hattori, McLeland & Naughton

[57] ABSTRACT

A printing system for a sectional circular container capable of having additions printed at a specified position on the surface of the sectional circular container with an IJP. In the printing system for printing the additions with an ink-jet printer at the specified position on the circumference of each sectional circular container which is previously printed on by a transfer drum, a conveyer member is provided at the position downstream, in the rotating direction of the transfer drum just behind the transfer drum and in which the conveyer member for conveying each container fixes the container against rotation. The ink-jet printer is provided in order to print on the circumference of each container during conveyance.

10 Claims, 5 Drawing Sheets

PRINTING SYSTEM FOR SECTIONAL CIRCULAR CONTAINER

BACKGROUND OF THE INVENTION 1. Field of the Invention

This invention relates to a printing system for a sectional container in order to carry out additional printings with an ink-jet printer at a specified location on the circumference of the sectional circular container previously printed on (its circumference) with a transfer drum. 2. Description of the Related Art In a conventional gravure-offset printing press, ink is transferred from an inscription roller to a transfer drum only once. The markings made by the inscription roller are often required to be changed. For example, the date frequently needs to be changed. Consequently, the inconvenience of changing the inscription roller every time and the necessity of multiple inscription rollers has caused a lot of wasted time and effort in using the conventional gravure-offset printing press.

On the other hand, an ink-jet printer (IJP), which is capable of having its printing patterns easily changed and which has a high processing ability, is known as a convenient system that can easily print additions, such as a date marking, onto the container.

However, for example, as shown in FIG. 1, the case when the additions, such as the date marking, are printed onto a specified position on the circumference of each sectional circular container 2, having previously been printed on the circumference of each container 2 with the transfer drum 1, each container 2 freely rotates (on its own axis) by conveying each printed container 2 in the direction A by using a conventional side-belt conveying method. A disadvantage, in which it is difficult to print (an accurately matched printing) with the IJP at the specified position on the circumference of the container during conveyance, is produced.

Reference numeral 3 represents a side belt, reference numeral 4 represents a guide rail, reference numeral 5 represents a driving motor for the side belt, and reference numeral 6 represents a timing screw.

The present invention is concerned with eliminating the disadvantage of the aforementioned conventional art. Consequently, it is an object of the present invention to provide the printing system for the sectional circular container which is capable of having the additions printed with the IJP at the specified position on the circumference of the sectional circular container.

SUMMARY OF THE INVENTION

A printing system for a sectional circular container according to the present invention, which has additions printed with an ink-jet printer at a specified position on the circumference of the sectional circular container previously printed on by a transfer drum, includes: a conveyer means, for conveying the container, provided at a position downstream, in the rotating direction of the transfer drum, just after the transfer drum, and in which the conveyer means conveying the container fixes the container against rotation; and an ink-jet printer for printing on the circumference of the container during the conveyance.

According to the present invention having the aforementioned structure, since the conveyer means conveying the container fixes the container against rotation, the container is in a fixed state while being conveyed by the conveyer means. Consequently, when the additions are printed, the position on the surface of the container relative to the IJP is usually fixed.

The container is in a fixed state while being conveyed by the conveyer means, so that the adjustment of the position on the surface of the container relative to the IJP is made possible by adjusting the position of the container on the conveyer means. Therefore, in the present invention, by providing an agreement fine-tuning guide to extend parallel to the conveyer means, the length of the guide (in the direction that the container is conveyed) and the contact pressure between the guide and the conveyed container, in contact with the guide, can be adjusted.

In the range where the agreement fine-tuning guide is provided, the container, having the additions printed on it, contacts the guide and continues to move while rotating (on its own axis). Consequently, when the length of the agreement fine-tuning guide, in the direction that the container is conveyed, and the distance between the container and the guide (namely, the contacting pressure between the container and the guide) is adjusted, the rotational frequency of the rotation of the container is controlled. As a result, when the rotational frequency of the rotation of the container is controlled, the position on the container relative to the IJP can be adjusted.

Further to the present invention, the conveyer means is a suction conveying apparatus conveying the container in such a manner as to maintain the container to be sucked on a sucking hole that is opened on a conveyer belt. In this case, it is advisable that the driving source of the conveyer belt be the same as the driving source of the transfer drum.

DETAILED DESCRIPTION OF THE PREFERRED EMBODIMENTS

Figure 1:
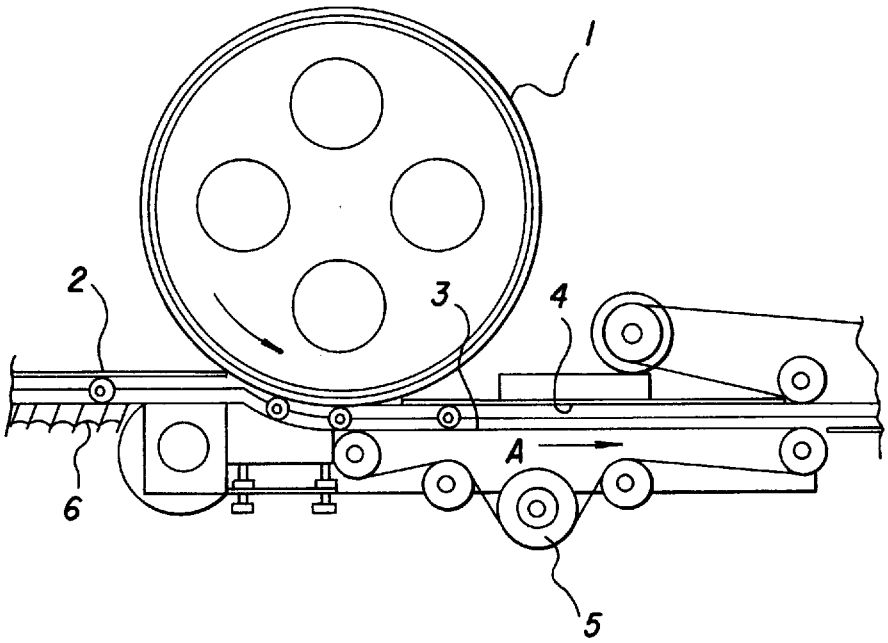
Fig. 1 PRIOR ART
FIG. 1 is a plan view showing an example of a conventional art.

The preferred embodiments of the present invention will be explained in detail below with reference to the attached drawings.

In the drawings, the same reference numerals will be used to designate the same or similar components of the conventional art, so that the description will be omitted or simplified.

Figure 2:
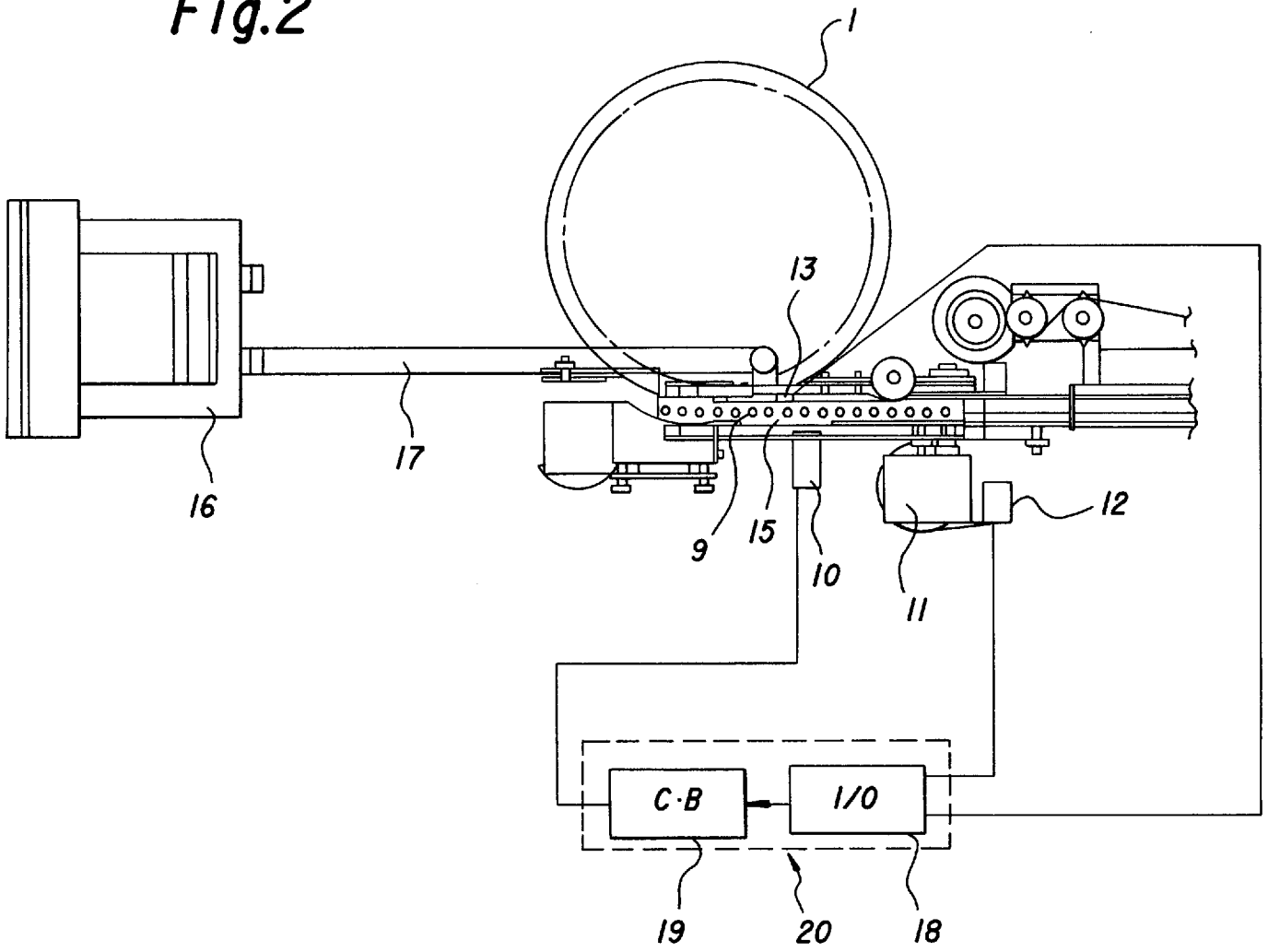
FIG. 2 is a block diagram of a printing system of the preferred embodiment according to the present invention.
Figure 3:
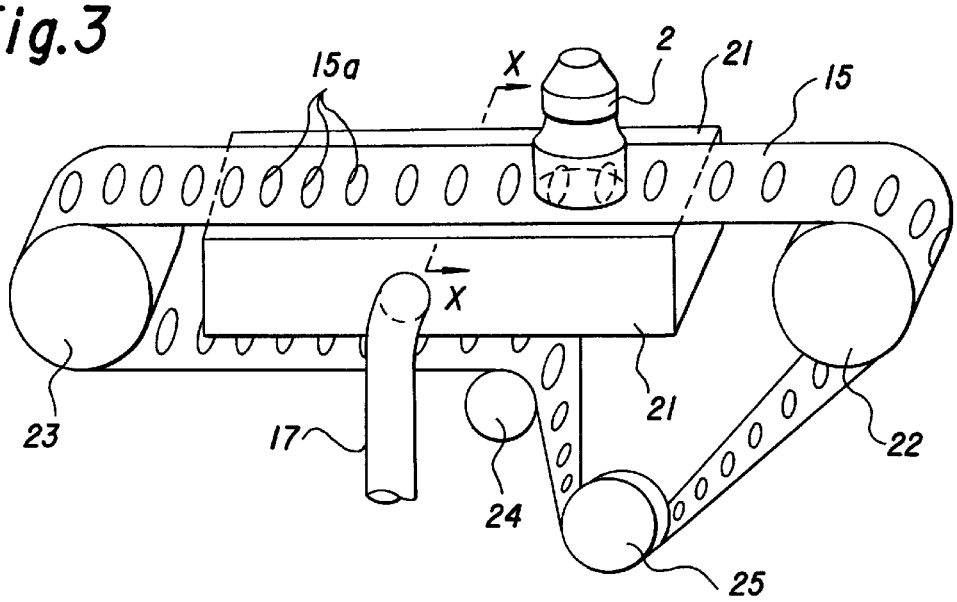
FIG. 3 is a perspective view of a suction conveying apparatus shown in FIG. 2.
Figure 4:
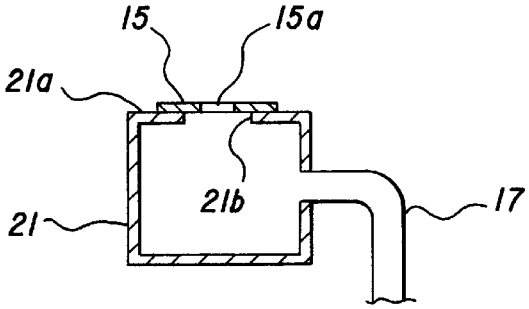
FIG. 4 is a sectional view taken along the X—X line in FIG. 3.
Figure 6:
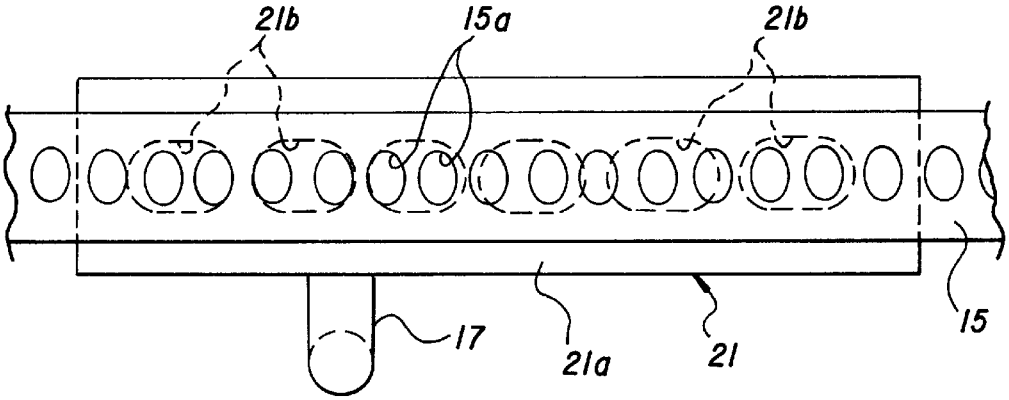
FIG. 6 is a plan view of the suction conveying apparatus shown in FIG. 3.

FIG. 2 is a plan view showing the appearance of the overall composition of a printing system for a sectional circular container according to the present invention, in which a belt 15 of a suction conveying apparatus is provided at position where printing is finished by a transfer drum 1. In FIGS. 3, 4 and 6, the belt 15 has a plurality of sucking holes 15*a*that are opened on the center line in the longitudinal direction of the belt 15, and further, a plurality of holes 21*b*, being slightly larger than the sucking holes 15*a* that are opened on the belt 15, are opened on the central line on a slide face 21*a* of a suction box 21 which sucks the belt 15 in the longitudinal direction. The suction box 21 is connected by an air intake tube 17 to an air intake device 16. The belt 15 is provided with rollers 23 and 24 capable of rotating, such that the belt 15 runs on the slide face 21*a* of the suction box 21, due to a roller 22 driven by a driving device 11, and is served with tension caused by a tension roller 25.

A printing nozzle-head 10 of an ink-jet printer 20 is fixed to be perpendicular to the belt 15. A sensor 13, detecting and relaying the position of the additions printed on the container, and a rotary encoder 12 of the driving device 11 are connected to an interface 18 through an electrical circuit, in which the interface 18 is connected to a control box 19, and the printing nozzle-head 10 is connected to the control box 19. A reference numeral 9 shows an agreement fine-tuning guide fine-tuning a position printed on the container 2.

Figure 7:
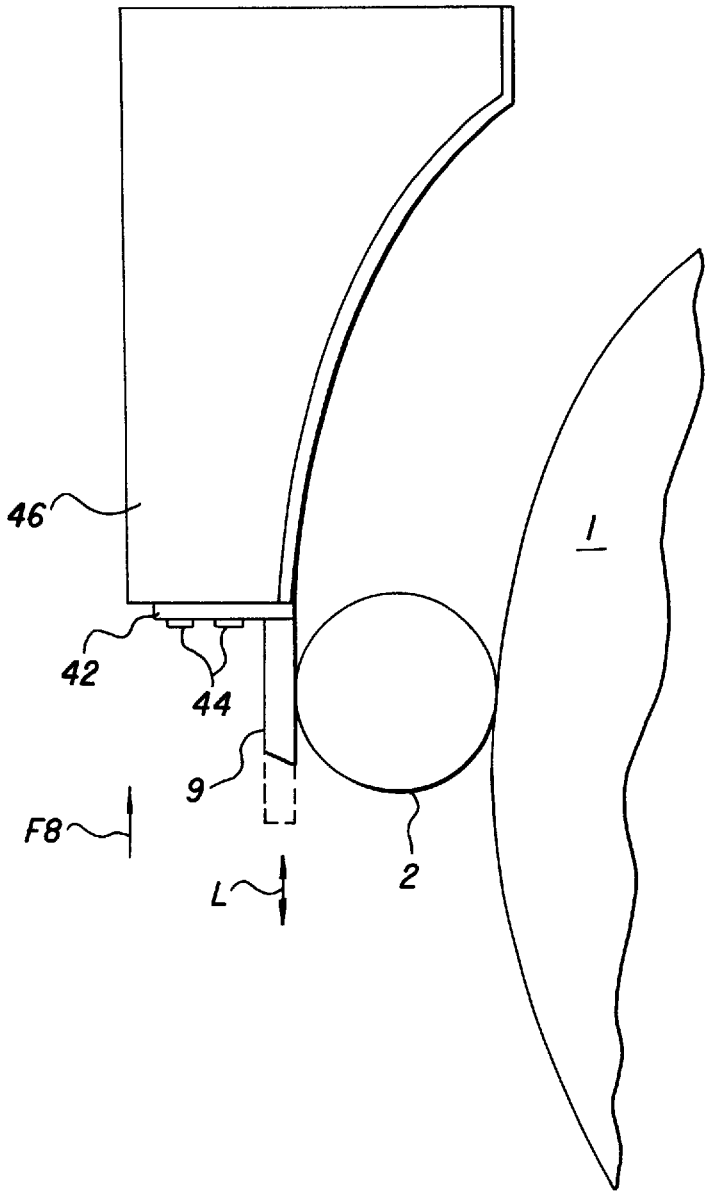
FIG. 7 is a plan view of an agreement fine-tuning guide shown in FIG. 2.
Figure 8:
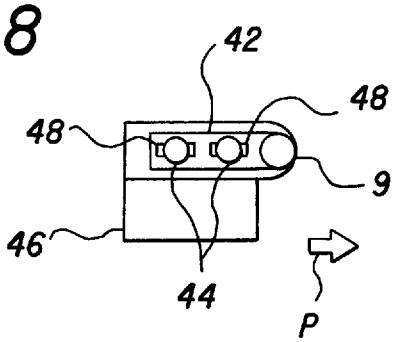
FIG. 8 is a plan view shown from the direction of arrow F8 in FIG. 7.

The agreement fine-tuning guide is illustrated in detail in FIGS. 7 and 8. In FIGS. 7 and 8, the agreement fine-tuning guide 9, composed of a cylinder-shaped member, is combined with a plate-like member 42. The combination of the agreement fine-tuning guide 9 and the plate-like member 42 are attached with screws 44 to a cover member 46 placed across from the transfer drum 1.

As shown in FIG. 8, the combination of the agreement fine-tuning guide 9 and the plate-like member 42 is attached to the cover member 46 (FIG. 7) by screwing screws 44 respectively inserted into elliptical holes 48 formed in the plate-like member 42. At this time, by adjusting the positions of the elliptical holes 48 relative to the screws 44, the pressure added to the container 2 between the transfer drum 1 and the guide 9 (the pressure shown with an arrow P in FIG. 8) can be adjusted.

As described above, in the range where the agreement fine-tuning guide 9 is provided, the container 2, printed with the additions, touches the guide 9 and continues to move while rotating (on its own axis). Therefore, when the length of the guide 9 is adjusted in the direction that the container is conveyed (the length in the direction of an arrow L in FIG. 7), the rotational frequency, by rotating the container on its own axis, is controlled, with the result that the position on the container 2 relative to the IJP is adjusted. The adjustment of the length of the guide 9 in the direction of the arrow L needs only to be carried once. Consequently, as shown in FIG. 7, the agreement fine-tuning guide 9 is adjusted with its length in the direction of the arrow L by removing the part illustrated by the dotted line.

As shown in FIGS. 3, 4 and 6, materials of the conveyer belt can be, for example, nylon or cloth and each interval between the sucking holes is not limited. However, advisable for the bottom of the container 2 to be covered with at least two sucking holes, in order to certainly prevent the container 2 from rotating, as shown in FIG. 2. Further, it is desirable that the suction force in the case of using a polystyrene-made container is 600–1,200 mmAq.

Figure 5:
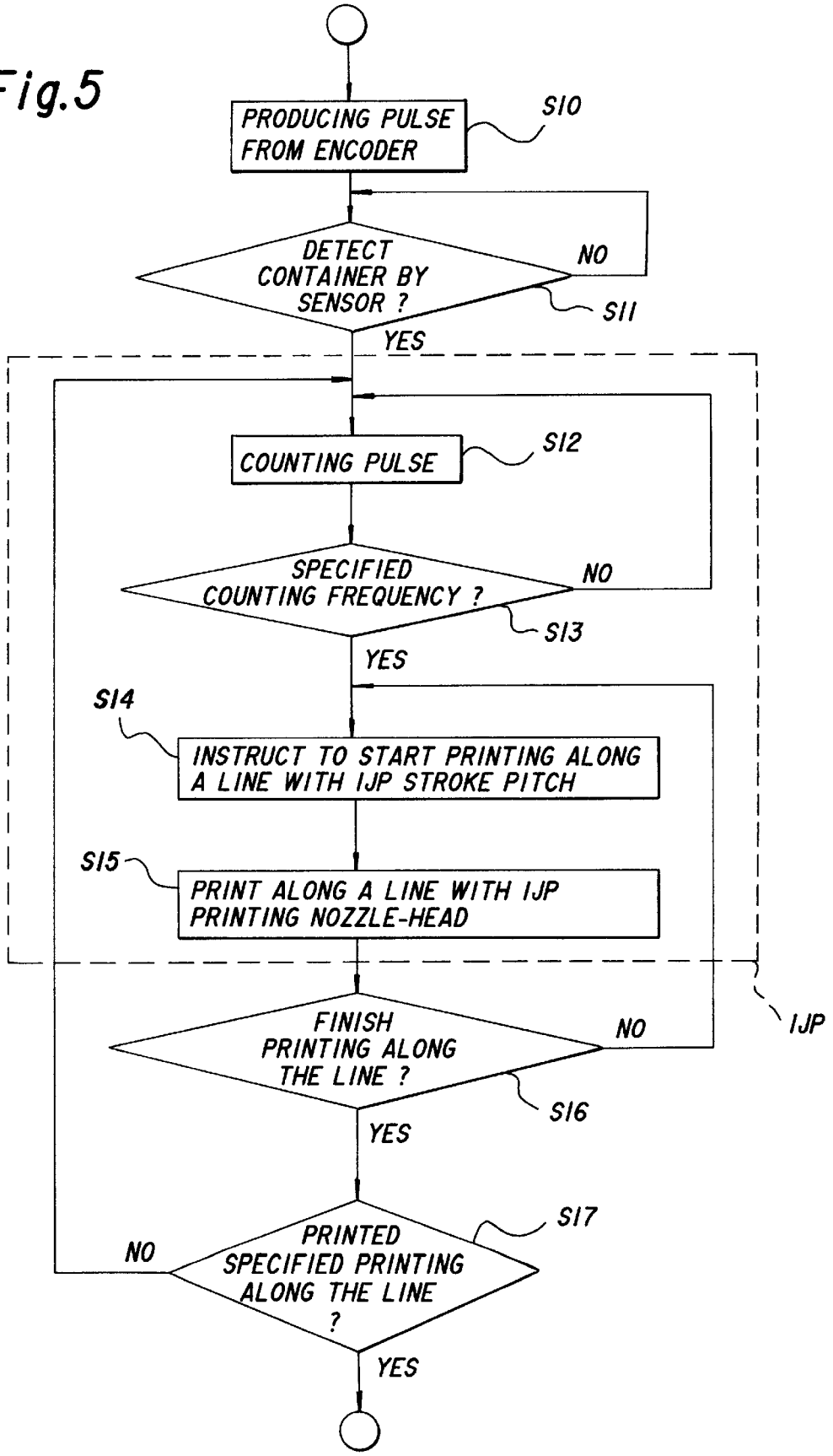
FIG. 5 is flow chart showing the control mechanisms in FIG. 2.

The control for printing the additions will be explained in detail below with reference to FIG. 5.

The control box 19 causes the rotary encoder 12 to produce a pulse (Step S10), and judges whether the sensor 13 detects the container 2 or not (Step S11). When the judgement in Step S11 is NO, the flow returns to the beginning. When the judgement is YES, namely, when the container 2 is detected, the counting pulse is started (Step S12), and it is judged whether the counting occurs according to a specified frequency (Step S13). When the counting is judged as occurring at the specified frequency, a signal for starting printing is outputted to the IJP printing nozzle-head 10 (Step S14), and printing takes place along one line (Step S15). The control box judges whether printing is completed or not (Step S16), and further, when the control box judges that printing is completed, the control box next judges whether the specified printing, namely, the additional printing for the specified marking, is completed or not (Step S17). When the control box judges that the specified printing is not completed, the flow returns to Step 12, and when the control box judges that the specified printing is completed, the control is completed.

Since the present invention is structured as described above, after printing the conventional gravure-offset printing markings, such as the date which changes frequently, can be printed such as an addition at the same position on the surface of the container by the simple structure. Further, the position of printing the additions can be easily changed by adjusting the length of the agreement fine-tuning guide in the direction that the container is conveyed and the contact pressure between the guide and container.

What is claimed:

1. A printing system comprising:

a transfer drum;

a container having a circumference and a circular cross-section, wherein said circumference of said container has been printed on by said transfer drum;

a conveyer means for conveying said container from a position just behind said transfer drum to a position downstream of said transfer drum, wherein said conveyer means includes a conveyer belt having a plurality of sucking holes therethrough and a suction conveying means, said conveyer means for conveying said container upon said conveyor belt fixes said container against rotation by air suction from said suction conveying means through said sucking holes to maintain a bottom surface of said container on a top surface of said conveyor belt;

an ink-jet printer means for printing additions on said container, which was previously printed on by said transfer drum, wherein said additions are printed at a specified position on said circumference of said container during conveyance of said container on said conveyer belt of said conveyer means; and an agreement fine tuning guide extending in a parallel direction to said conveyer means, and wherein a length of said agreement fine tuning guide in a direction that said container is being conveyed and a distance between said agreement fine-tuning guide and said container are adjusted, wherein said agreement fine-tuning guide includes a cylindrical member combined with a plate-shaped member which are attached by screws to a cover member placed across from said transfer drum.

2. The printing system according to claim 1, further comprising elliptical holes, wherein said screws attaching said agreement fine-tuning guide and said plate-shaped member to said cover member are inserted into said elliptical holes in said plate-shaped member so that by adjusting positions of said elliptical holes with respect to said screws, a pressure on said container between said transfer drum and said agreement fine-tuning guide is adjusted.

3. The printing system according to claim 1, wherein said suction conveying apparatus includes a suction box with a slide face having a hole therein and an air intake tube.

4. The printing system according to claim 3, wherein said hole of said suction box is large enough so that two sucking holes of said conveyer belt are enclosed within said hole of said suction box.

5. The printing system according to claim 4, wherein said slide face comes into with said conveyer belt so that air suction from said air intake tube passes through said hole in said slide face of said suction box and through said sucking holes to maintain said container fixedly on said conveyer belt.

6. The printing system according to claim 5, wherein at least two sucking holes are used to maintain said bottom of said container fixedly on said top of said conveyer belt.

7. The printing system according to claim 6, wherein said ink-jet printer means includes a printer nozzle-head fixed perpendicular to said conveyer belt.

8. The printer system according to claim 7, wherein said printing nozzle-head is connected to a control box.

9. The printing system according to claim 8, further comprising an interface which is connected to said control box.

10. The printing system according to claim 9, further comprising a driving means, an electric circuit, and a sensor means, said sensor means for detecting and relaying positions of said additions printed on said container and a rotary encoder of said driving means, wherein both said sensor means and said rotary encoder are connected to said interface through said electric circuit.

* * * * *